US011359427B2

(12) United States Patent
Liebermann et al.

(10) Patent No.: US 11,359,427 B2
(45) Date of Patent: Jun. 14, 2022

(54) HOLDING AND OPENING MECHANISM

(71) Applicant: Andreas Hettich GmbH & Co. KG, Tuttlingen (DE)

(72) Inventors: Timo Liebermann, Muehlheim (DE); Klaus-Guenter Eberle, Tuttlingen (DE)

(73) Assignee: Andreas Hettich GmbH & Co. KG, Tuttlingen (DE)

( * ) Notice: Subject to any disclaimer, the term of this patent is extended or adjusted under 35 U.S.C. 154(b) by 0 days.

(21) Appl. No.: 16/940,706

(22) Filed: Jul. 28, 2020

(65) Prior Publication Data

US 2021/0032918 A1 Feb. 4, 2021

(30) Foreign Application Priority Data

Aug. 2, 2019 (DE) ..... 102019121011.9

(51) Int. Cl.
*E05D 11/10* (2006.01)
*E05F 3/18* (2006.01)
*E05F 3/20* (2006.01)

(52) U.S. Cl.
CPC . *E05F 3/18* (2013.01); *E05F 3/20* (2013.01)

(58) Field of Classification Search
CPC ..... Y10T 16/53885; Y10T 16/5389; Y10T 16/54025; Y10T 16/540253;
(Continued)

(56) References Cited

U.S. PATENT DOCUMENTS 2,219,820 A * 10/1940 Schonitzer ..... E05F 1/1253 16/221
3,476,375 A * 11/1969 Brasseur ..... E05F 1/1238 267/277
(Continued)

FOREIGN PATENT DOCUMENTS

EP 3103555 A1 12/2016

OTHER PUBLICATIONS

Extended European Search Report for EP20187270.2, 9 pages, dated Dec. 9, 2020, Arnold Geerts.
(Continued)

*Primary Examiner* — Chuck Y Mah
(74) *Attorney, Agent, or Firm* — Dicke, Billig & Czaja, PLLC

(57) ABSTRACT

A holding and opening mechanism for a pivoting element which is mounted to be pivotable relative to a supporting element about a first axle via a joint, with a pivoting arm acting between the pivoting element and the supporting element is provided. The pivoting arm is pivotally mounted about a second axle wherein the free end of the pivoting arm acts on a control surface of a guide element. A torsion spring is provided which acts on the pivoting arm in the direction around the second axle, a fixed part and a part pivotable relative thereto likewise provided, with the one part including the guide element and the other part including the pivoting arm. The pivotable part is adapted to be pivotable relative to the fixed part about the joint and the first axle, the pivotable part is connected to the pivoting arm and the pivoting element and the fixed part is connected to the supporting element, the control surface in cooperation with the torsion spring and the pivoting arm determines the holding and opening force via the pivot angle of the pivoting element.

20 Claims, 7 Drawing Sheets

(58) Field of Classification Search
CPC ..... Y10T 16/540256; Y10T 16/540254; Y10T 16/54026; Y10T 16/54029; Y10T 16/5409; Y10T 16/5398; Y10T 16/5383; Y10T 16/54024; Y10T 16/5404; Y10T 16/5406; Y10T 16/5407; Y10T 16/544; E05F 3/20; E05F 3/14; E05F 3/16; E05F 3/22; E05F 1/12; E05F 1/1284; E05F 5/02; E05D 3/122; E05D 2/02; E05D 11/1007; E05Y 2201/21; E05Y 2201/218; E05Y 2201/48; E05Y 2201/266; E05Y 2800/26; E05Y 2800/465; E05Y 2800/674; E05Y 2900/312; D06F 39/12
See application file for complete search history.

(56) References Cited

U.S. PATENT DOCUMENTS 3,763,519 A * 10/1973 Favre ..... E05F 1/105 16/72
3,787,923 A * 1/1974 Peterson ..... E05F 1/12 16/308
4,348,786 A * 9/1982 Hirose ..... E05F 1/123 16/308
4,571,775 A 2/1986 Leonard
4,589,164 A 5/1986 Leonard
4,621,391 A * 11/1986 Leonard ..... E05F 1/123 16/299
4,670,940 A 6/1987 Leonard
5,000,430 A 3/1991 Smith
5,136,811 A * 8/1992 Lyons, Sr. ..... E05F 1/123 49/386
5,361,926 A * 11/1994 Messner ..... B04B 7/02 220/811
5,373,665 A * 12/1994 Lyons, Sr. ..... E04D 13/0354 16/308
5,515,876 A * 5/1996 Warner ..... A47L 15/4261 134/200
5,893,478 A * 4/1999 Maruoka ..... E05B 83/32 220/827
7,350,845 B1 * 4/2008 Duffy ..... E05F 1/1215 16/296
7,367,069 B2 * 5/2008 Connell ..... A47C 17/86 5/136
7,815,560 B2 * 10/2010 Hayasaka ..... B04B 7/02 494/60
7,900,320 B2 * 3/2011 Katsumata ..... G03G 15/60 16/286
8,887,448 B2 * 11/2014 VanMeter ..... H02G 9/10 52/20
9,458,653 B2 * 10/2016 Wickliffe ..... E05D 11/1042
10,338,626 B2 * 7/2019 Lewis ..... E05F 1/12
10,382,636 B2 * 8/2019 Miura ..... E05F 5/00
10,648,209 B2 * 5/2020 Sedivy ..... E05D 1/02
10,704,311 B1 * 7/2020 Collene ..... E05F 5/02
2005/0081293 A1 4/2005 Connell et al.
2007/0130725 A1 * 6/2007 Ness ..... E05D 15/0669 16/105

OTHER PUBLICATIONS

Search Report for DE 102019121011.9 with machine translation; 9 pages; GPTO; dated Aug. 9, 2020.

* cited by examiner

HOLDING AND OPENING MECHANISM

CROSS-REFERENCE TO RELATED APPLICATIONS

This application claims priority under 35 U.S.C. § 119 to German patent application DE 10 2019 121 011.9, filed Aug. 2, 2019, the disclosure of which is incorporated herein by reference in its entirety.

TECHNICAL FIELD

The invention relates to a holding and opening mechanism for a pivoting element such as a lid, a cover, a door or the like, which is mounted so as to be pivotable relative to a supporting element such as a housing, a frame or the like about a first axle via a joint.

BACKGROUND OF THE INVENTION

A generic holding and opening mechanism is known to be distributed by the U.S.-based company Southco, under the name CB (counterbalanced) hinges with torsion spring. This holding and opening mechanism is designed for a pivoting element, such as a lid, a cover, a door or the like, which is mounted to be pivotable, relative to a supporting element such as a housing, a frame or the like, about a first axle via a joint. The holding and opening mechanism comprises a pivoting arm which is effective between the pivoting element and the supporting element and which is pivotally mounted about a second axle that is not the same as the first axle. The free end of the pivoting arm acts, preferably via a roller, on a control surface of a guide element. In addition, a torsion spring is provided which acts on the pivoting arm in a direction around the second axle so as to generate a holding and opening force on the pivoting arm and on the control surface. Furthermore, a fixed part and a part pivotable relative thereto are provided, with the pivotable part comprising the guide element and the fixed part comprising the pivoting arm. The pivotable part is adapted to be pivotable relative to the fixed part about the joint and said first axle. The pivotable part is connected to the pivoting arm and the pivoting element, and the fixed part is connected to the supporting element. The control surface, in cooperation with the torsion spring and the pivoting arm, determines the holding and opening force via the pivot angle of the pivoting element.

This type of holding and opening mechanism only has a limited range of application as it does not meet all safety requirements. Particularly in the case of heavy pivoting elements of low height, such as machine covers, the cover tends to warp during opening or closing because the holding and opening mechanism is mounted on one side only, and this may result in jamming. If a plurality of holding and opening mechanisms were provided, this would further increase the weight of the cover. The holding and opening force acting on the cover may also vary when plural holding and opening mechanisms are provided, so that warping may still occur, thus resulting in undesired tensile and/or shearing stresses in the cover. Setting an identical holding and opening force when using plural holding and opening mechanisms is difficult. Moreover, it is a disadvantage that part of a user's clothing or their fingers may become trapped between the roller of the pivoting arm and the control surface. Also, dirt may collect on the control surface and the roller of the pivoting arm. This is why, for many medical devices, a prior art holding and opening mechanism is not an option, because the dirt depositing on the holding and opening mechanism may lead to sample contamination.

On the other hand, centrifuges having a holding and opening mechanism are known which exhibit a relatively closed system. An essential part of this holding and opening mechanism is a gas spring, which tends to wear out easily, however, and therefore is of limited durability. Moreover, oil leakage from the gas spring can also result in sample contamination. These holding and opening mechanisms for centrifuges are each provided with an end stop. Moreover, if a user pulls too hard on the cover of the rotor compartment to open it, the cover may hit the end stop and thus rattle the centrifuge. This will adversely affect the samples contained in the centrifuge. The gas spring has a linear holding and opening force which is insufficient to cope with the forces and torques occurring over the pivot angle of the rotor compartment cover.

BRIEF SUMMARY OF THE INVENTION(S)

It is the object of the invention to create a holding and opening mechanism of the type specified in the preamble of claim 1 which fulfils the structural conditions required for reliable operation even in the case of medical devices. In particular, sample contamination is to be prevented from the outset, and at the same time it is to be ensured that the force required for moving the cover of the rotor compartment is almost always identical over the entire pivoting path of the rotor compartment cover. In addition, any vibrations occurring during the opening or closing of the cover are to be avoided.

This object is accomplished by the characteristic features of claim 1 in conjunction with the features of its preamble.

The dependent claims relate to advantageous embodiments of the invention.

The invention is based on the finding that integrating multiple pivoting arms, guide elements, joints as well as fixed and pivotable parts in a holding and opening mechanism allows the holding and opening force to be more evenly distributed on the pivoting element without significantly increasing the weight of the holding and opening mechanism itself.

According to the invention, multiple pivoting arms, guide elements, joints and fixed and pivotable parts are therefore provided, which pivoting arms are coupled to each other by a common torsion spring or bar in the second axle. This results in an integrated, weight-saving solution of a holding and opening mechanism which provides additional design benefits, as are described below. The holding and opening force on the pivoting arm is always the same in this case.

Preferably, the torsion spring extends through the pivoting arm and is arranged and fixed in the fixed part or in the pivotable part. The pivoting arms are thus connected to this part via the torsion spring. In each case, the pivoting arm is fixed on the torsion spring for co-rotation therewith. By pivoting the pivoting arms relative to the torsion spring, the latter will be biased more or less, depending on the pivoting direction. This means that a greater or lesser holding and opening force will act on the pivoting arms.

Since the distance between the part in which the torsion spring is mounted and the pivoting arm can be relatively small, and therefore high shear forces can occur in the torsion spring, the torsion spring is constituted by fiberglass rods. In particular, several packages of fiberglass rods can be provided which together form the torsion spring.

According to one embodiment of the invention, the torsion spring or bar extends over 70%, in particular over 80%, of the width of the pivoting element. This allows the pivoting arms to be arranged optimally on the torsion spring with respect to the pivoting element.

Preferably, the bias of the torsion bar can be adjusted, in particular by the angular position of the pivoting arm in relation to the torsion spring with the part in which it is mounted. The holding and opening force can be adjusted via this angular position.

In order to prevent in particular the user's fingers and/or part of the user's clothing from becoming trapped, the guide element is arranged in the fixed part and the pivoting arm is pivotably arranged in the pivotable part. Moreover, this also reduces the moving masses in the pivoting element during opening and closing. In particular, proceeding from the second axle, the free end of the pivoting arm with the roller essentially extends in the closing direction of the pivoting element.

As little dirt as possible is to collect on the holding and opening mechanism. Therefore, the second axle with the torsion spring can be integrated into the pivoting element in such a way that only the pivoting arm protrudes from the pivoting element, with the remaining axle being covered by the torsion spring.

According to one embodiment of the invention, the joint can be designed as a hinge. The hinge comprises a fixed hinge portion connected to the fixed part and a movable hinge portion connected to the movable part. In this case, the guide element and the fixed hinge portion are integrally formed, and in particular also substantially made of the same material.

Various parameters can contribute to the adjustment of the holding and opening force and thus to the desired pivoting behavior. For this purpose, in particular the control surface of the guide element is designed as a function of the force of the torsion spring, the weight of the pivoting element, the weight of the pivoting arm and/or the geometry, in particular the arrangement of the center of gravity, of the pivoting element to yield the desired pivoting behavior of the pivoting element.

Likewise, it is easy to set the maximum opening angle of the pivoting arm and thus of the pivoting element by means of the appropriate shape of the guide element and/or the appropriate design of the control surface of the guide element.

In order to additionally protect the holding and opening mechanism from dirt, the first axle and the joint can be integrated into the pivoting element in such a way that only a connection piece between the fixed hinge portion and the guide element will protrude from the pivoting element.

According to one embodiment of the invention, the movable part is designed as a mounting support to which the pivoting element is attached. This makes it easy to attach a cover of a centrifuge, for example, to the mounting support.

In order to enable the smoothest possible movement with the same amount of force in the opening or closing direction of the pivoting element, the surface of the roller on the pivoting arm comprises metal. More specifically, this surface is formed by a coating.

The roller can be supported by a ball bearing or a plain bearing and/or the control surface of the guide element associated with the roller can be made of metal.

The moving masses are to be kept as low-weight as possible. It is therefore considered advantageous to design the pivoting arm as lightweight as possible. For example, the pivoting arm can be made of aluminum or of an aluminum alloy.

For safety reasons, the orientation of the roller with respect to the pivoting arm can be a decisive factor. Therefore, it is preferable to mount the roller on the free end of the pivoting arm laterally with respect to the pivoting arm.

According to another aspect thereof, the invention relates a centrifuge having a holding and opening mechanism of the type described above. In this case, the pivoting element is constituted by a pivotable rotor compartment cover and the supporting element is constituted by a housing.

For safety reasons, the roller is located on the side of the pivoting arm which faces the centrifuge housing. This is an easy way of preventing the user from trapping their clothing or fingers therein.

In order to distribute the holding and opening force as evenly as possible over the rotor space cover of the centrifuge, a pivoting arm, a guide element, a joint, a fixed part and a pivotable part are preferably provided on either side of the rotor space cover, with the pivoting arms having the common torsion spring in the second axle.

Additional advantages and possible applications of the present invention may be gathered from the description which follows, in which reference is made to the embodiments illustrated in the drawings.

BRIEF DESCRIPTION OF THE DRAWINGS

Throughout the description, the claims and the drawings, those terms and associated reference signs are used as are indicated in the list of reference signs below. In the drawings:

DETAILED DESCRIPTION OF THE INVENTION

Figure 1:
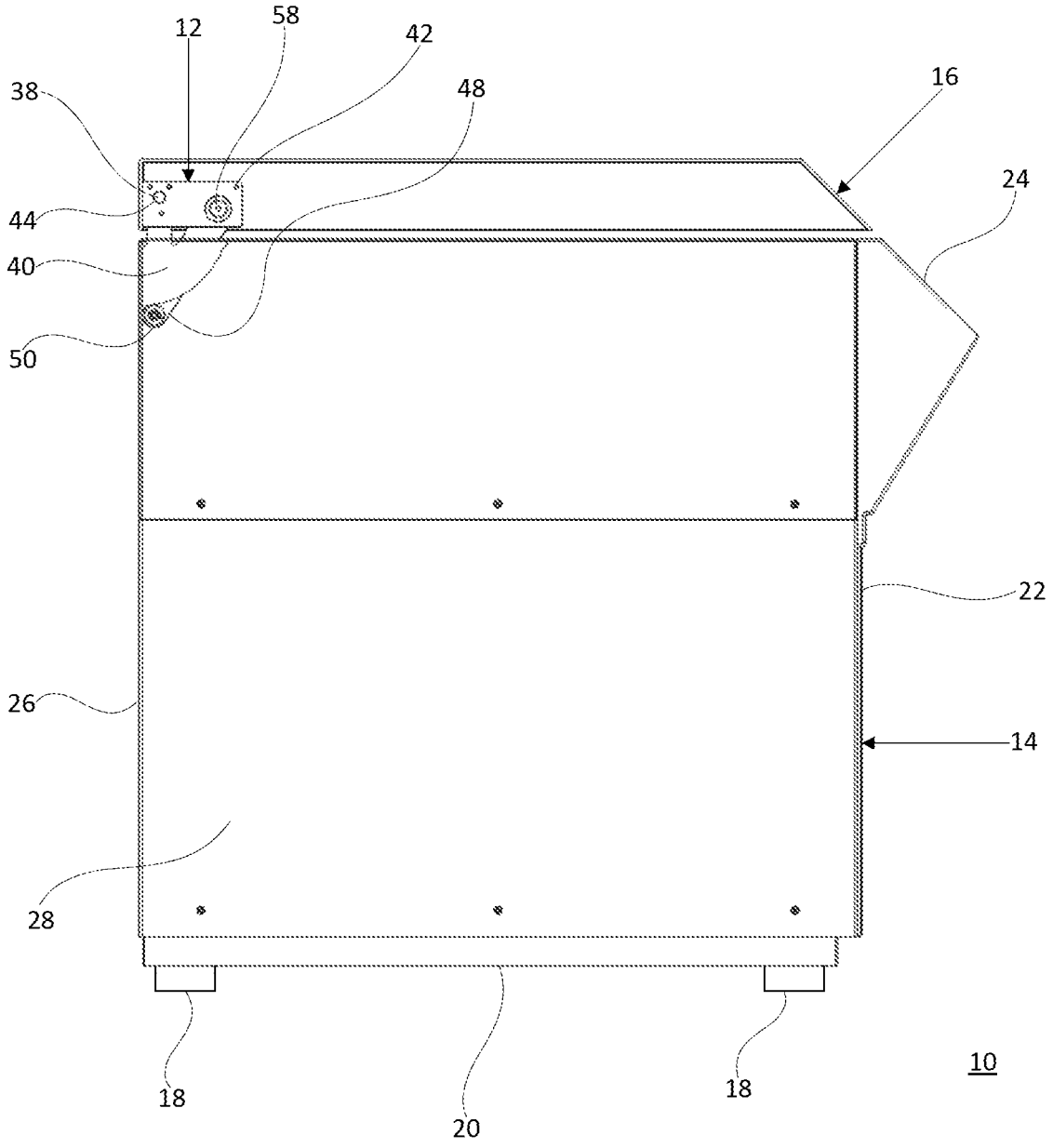
FIG. 1 is a lateral view of a centrifuge having a holding and closing mechanism according to the invention with a closed rotor compartment cover.

FIGS. 1 to 7 illustrate an embodiment of a centrifuge 10 having a holding and opening mechanism 12.

The centrifuge 10 consists of a housing 14 and a rotor compartment cover 16. The housing 14 stands on feet 18 which are attached to a base 20 of the housing 14. At the front 22 of the centrifuge 10 a control panel 24 extends over the width of the front side 22.

On the side of the housing 14 remote from the front side 22 is the back side 26 of the housing. The front side 22 and the back side 26 are connected on the left side by a left sidewall 28 and a right sidewall 30. The upper part of the housing 14 has a top wall 32 that is provided with a circular recess 34. Located below the circular recess 34 is a rotor compartment 36.

Figure 2:
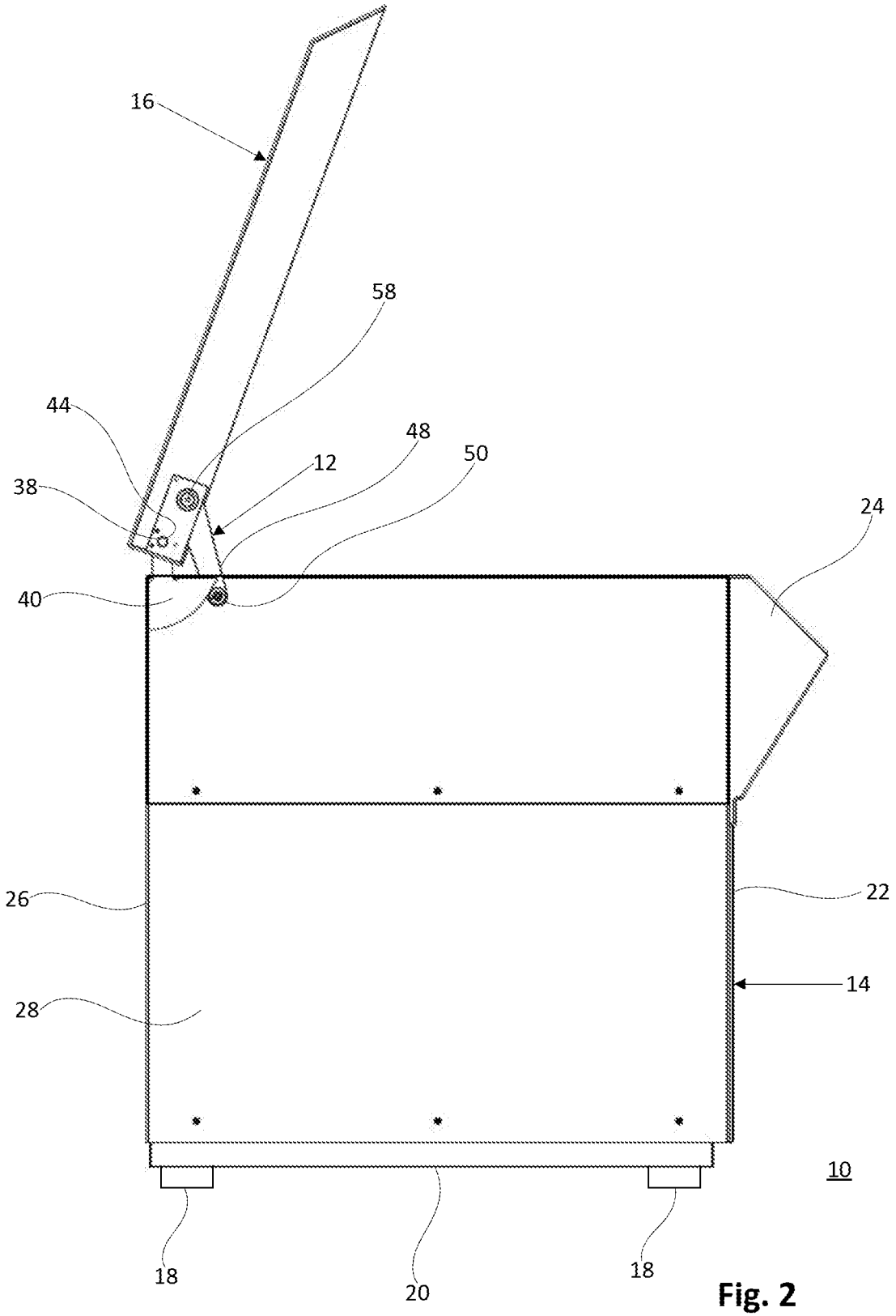
FIG. 2 is a lateral view similar to that of FIG. 1, but with the rotor compartment cover open.
Figure 3:
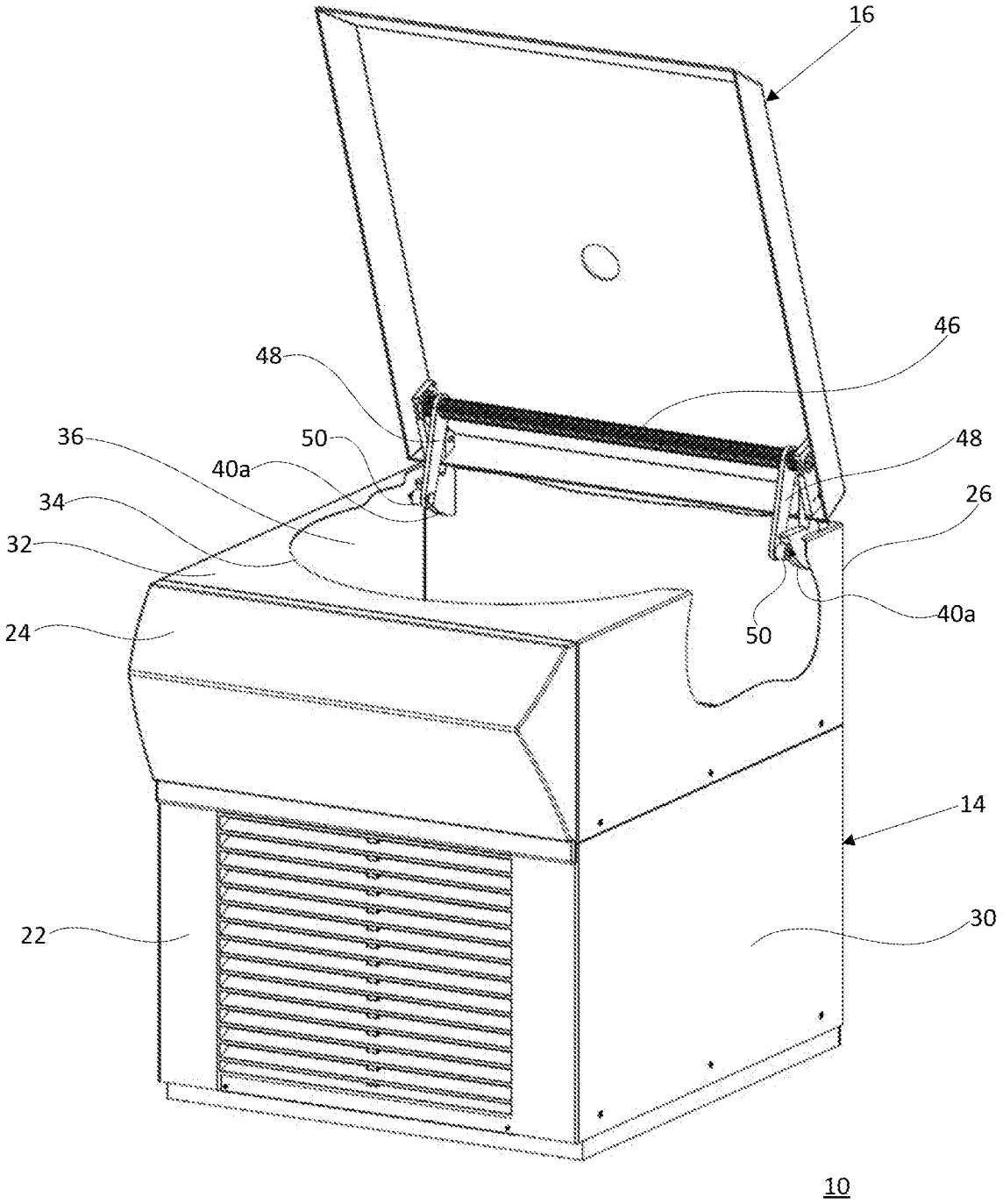
FIG. 3 is a perspective lateral view of the centrifuge of FIG. 1 as seen at an angle from above, with the rotor compartment cover open and a lateral cut-out revealing the interior of the rotor compartment.
Figure 4:
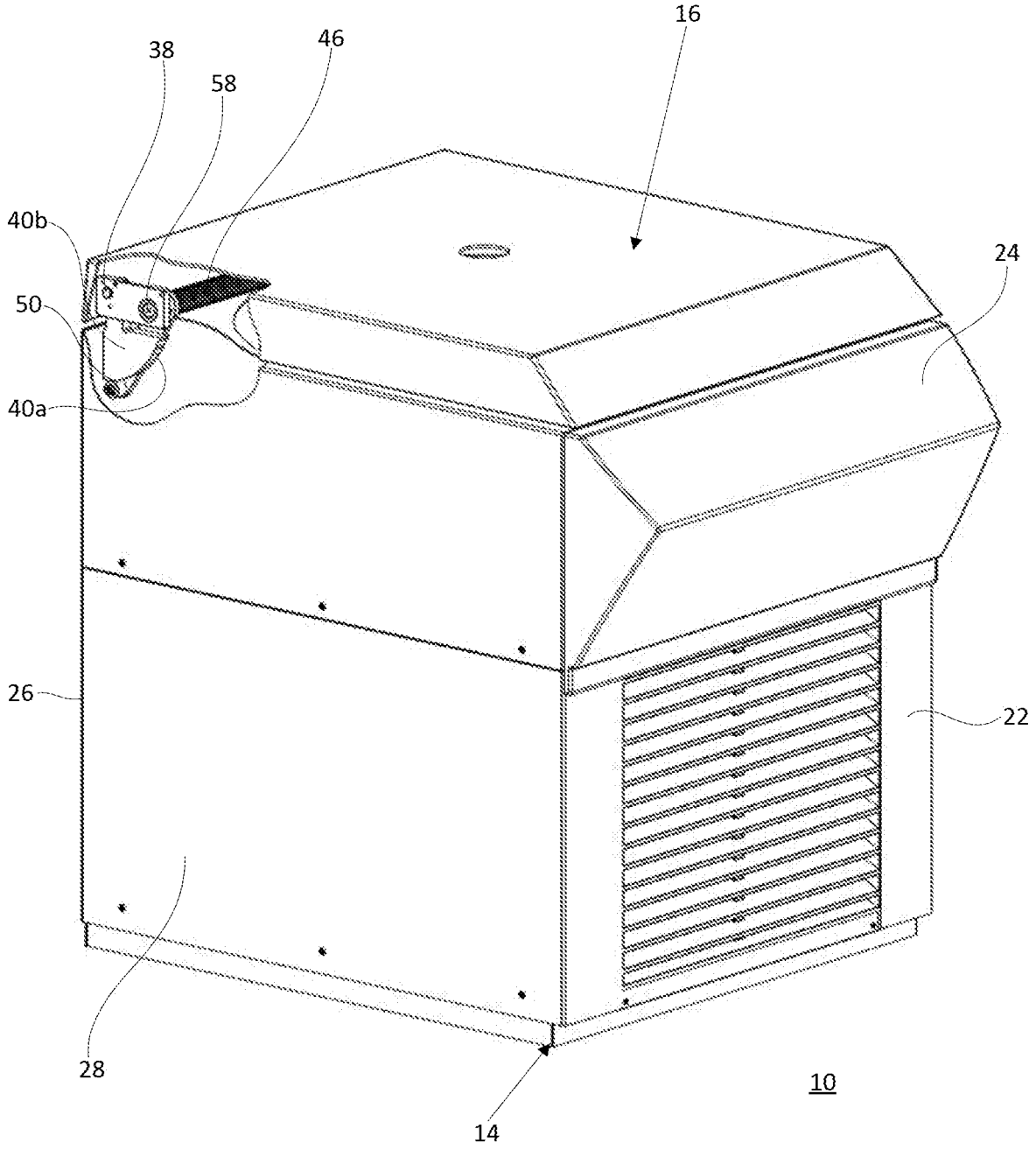
FIG. 4 is a perspective lateral view of the centrifuge of FIG. 1 as seen at an angle from above with the rotor compartment cover closed and a lateral cut-out revealing the interior of the rotor compartment.
Figure 5:
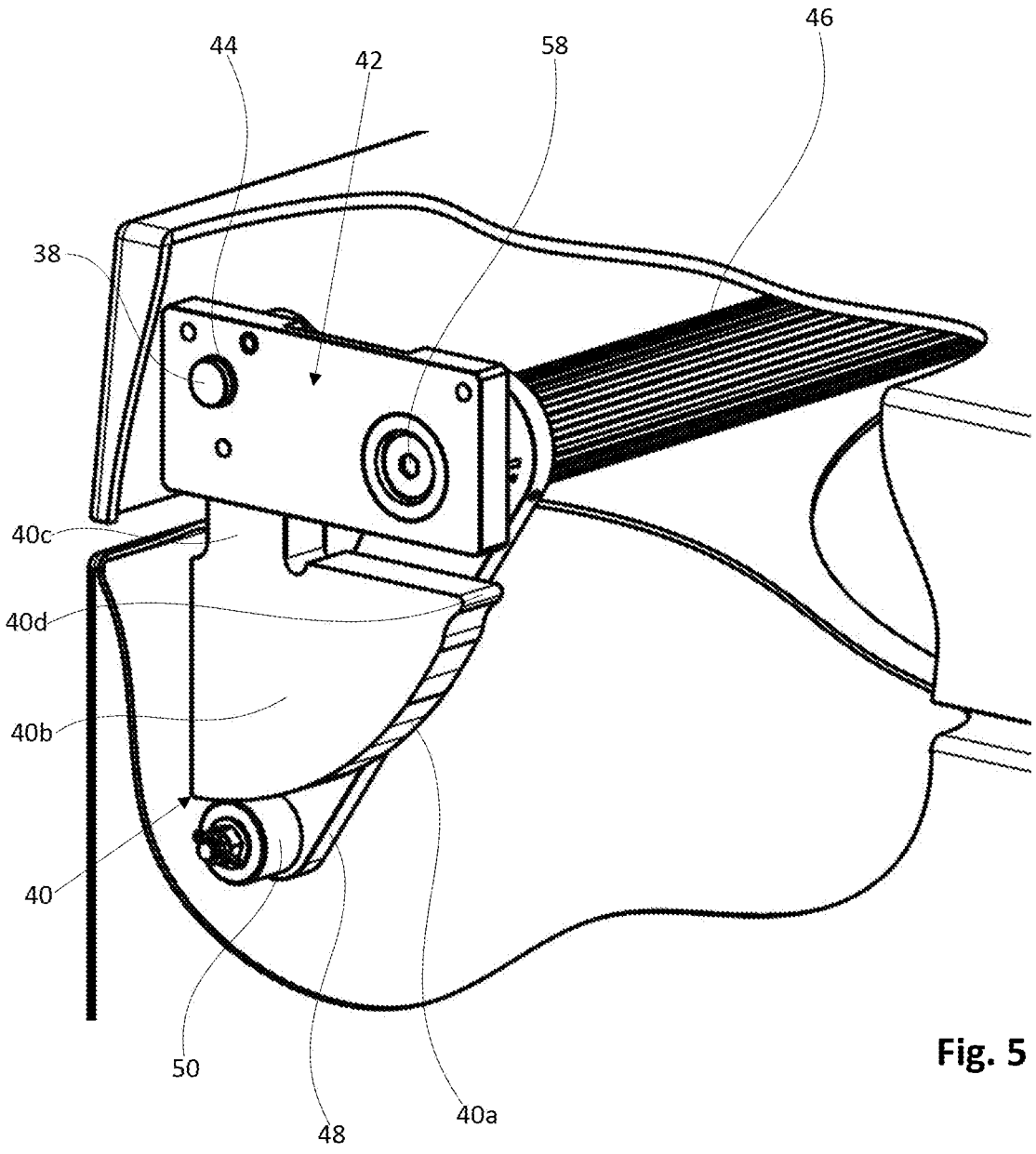
FIG. 5 is an enlarged view of the holding and opening mechanism of FIG. 4.
Figure 6:
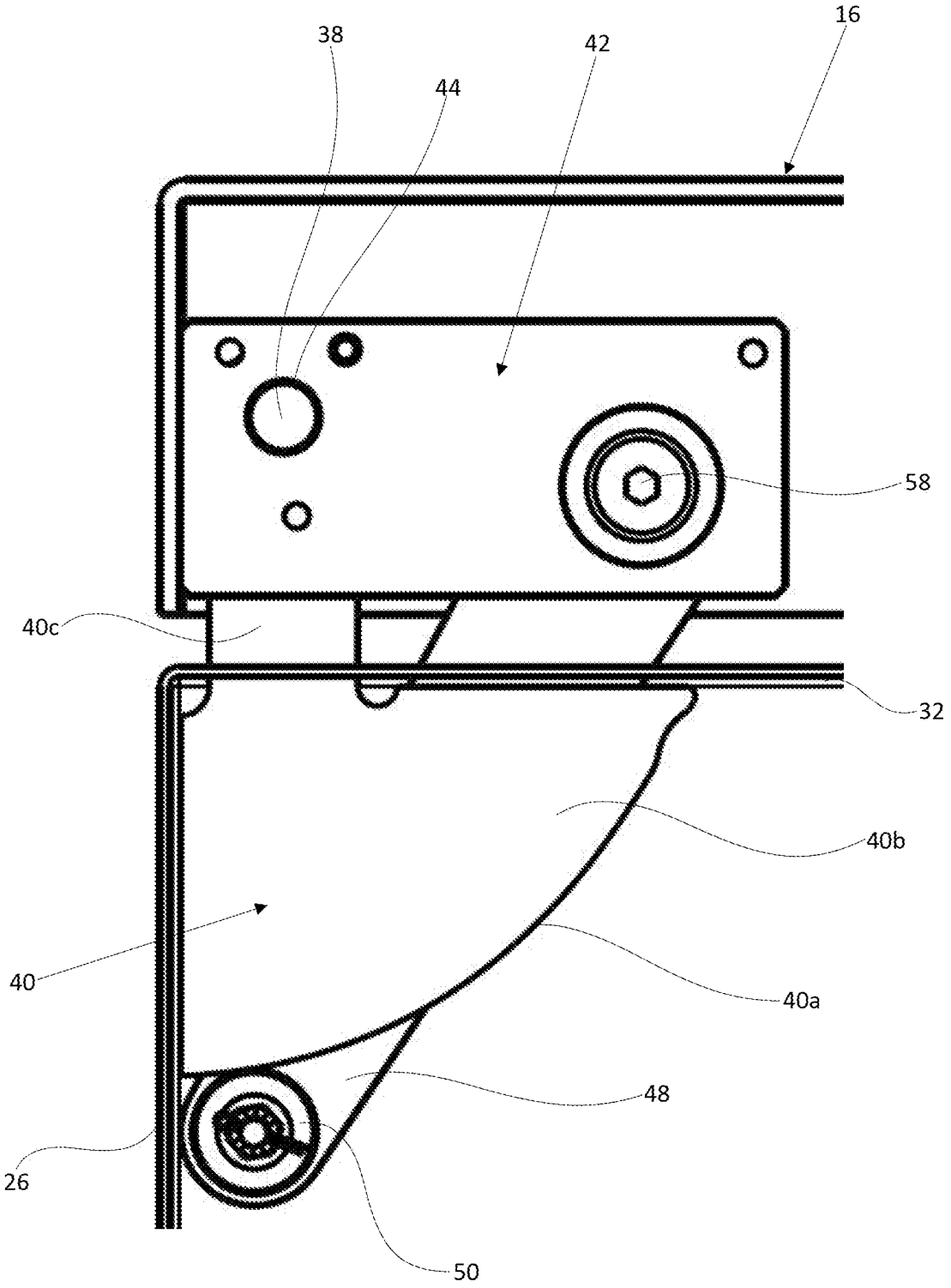
FIG. 6 is a lateral view of the holding and opening mechanism of FIG. 4.
Figure 7:
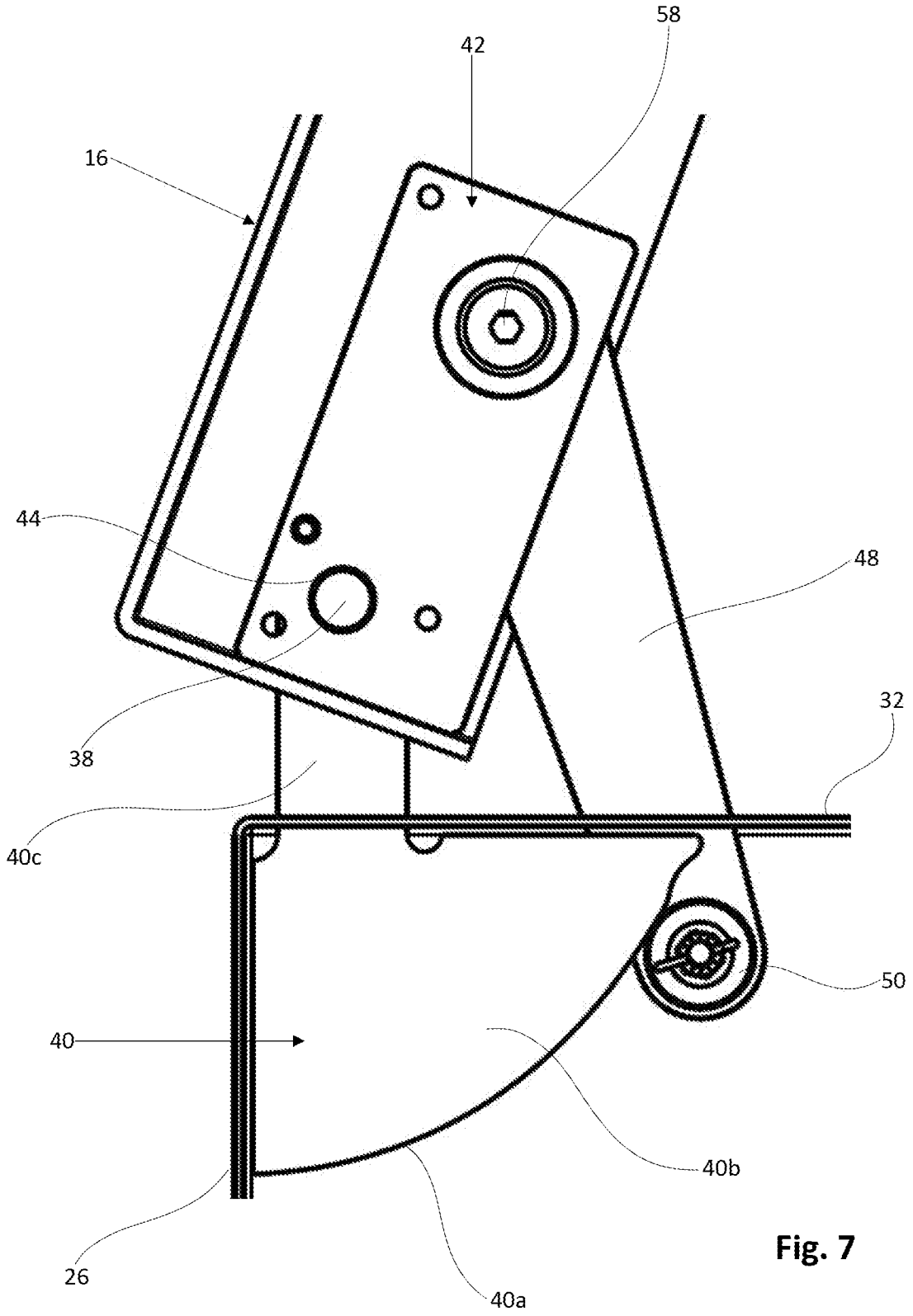
FIG. 7 is a lateral view of the holding and opening mechanism of FIG. 6, but with the rotor compartment cover open.

The rotor compartment cover 16 is mounted on the housing 14 in such a way that it can be pivoted about a first axle 38 from a closed position, see FIG. 1, FIG. 4, FIG. 5 and FIG. 6, into an open position and vice versa, see FIG. 2, FIG. 3 and FIG. 7. In order to pivotally connect the rotor compartment cover 16 to the housing 14, the holding and opening mechanism 12 is arranged in the region of the back side 26 of the housing 14 and the rotor compartment cover 16.

The holding and opening mechanism 12 consists of a fixed part 40 that is connected to the housing 14 and a pivotable part 42 that is connected to the rotor compartment cover 16. The fixed part 40 connected to the housing 14 and the pivotable part 42 connected to the rotor compartment cover 16 are connected to each other by a hinge 44, with the hinge 44 being adapted to pivot about the first axle 38.

A first unit comprising the fixed part 40 with the pivotable part 42 connected thereto by the hinge 44 is arranged in the area of the left sidewall 28 of the housing 14 and another, second unit comprising the fixed part 40 with the pivotable part 42 connected thereto by the hinge 44 is arranged in the area of the right sidewall 30. Accordingly, the fixed part 40 of the first unit is connected to the housing 14 in the area of the left sidewall 28 thereof, and the fixed part 40 of the second unit is connected to the housing in the area of the right sidewall 30 thereof. The pivotable part 42 of the first unit is connected to the rotor compartment cover 16 in the area of the left sidewall, and the pivotable part 42 of the second unit is connected to the rotor compartment cover 16 in the area of the right sidewall, see in particular FIG. 3.

Between the pivotable part 42 of the first unit and the pivotable part 42 of the second unit, a torsion spring 46 extends along a second axle 58 and at a distance from the first axle 38, which is firmly anchored in each of the pivotable parts 42. The second axle 58, and thus the torsion spring 46, is aligned parallel to the first axle 38. The torsion spring 46 extends almost completely over the entire width of the rotor compartment cover 16.

On the torsion spring 46, in the area of the first unit and in the area of the second unit, a pivoting arm 48 each is arranged for co-rotation with the biased torsion spring 46. The torsion spring 46 extends through the upper area of the pivoting arm 48. Proceeding from the torsion spring 46, the pivoting arm 48 extends downwards in the closing direction of the rotor compartment cover 16. In the area of the free end of the pivoting arm 48 remote from the torsion spring 46, one roller 50 each is rotatably mounted by way of a ball bearing on the side of the pivoting arm 48 that faces the sidewall 28, 30. The roller 50 rests against a control surface 40*a* of the fixed part 40 and is adapted to roll over the control surface 40*a* during the opening and closing movements of the rotor compartment cover 16. The lower portion of the fixed part 40 thus forms a guide element 40*b* with the control surface 40*a* for the pivoting arm 48. The control surface 40*a* and the guide element 40*b* extend from the top wall 32 downwards into the housing 14, but outside the rotor compartment 36.

Proceeding from this guide element 40*b* with control surface 40*a*, the fixed part 40 is provided with an upwardly extending bearing portion 40*c* that comprises the fixed part of the hinge 44, namely an axis of rotation which is identical to the first axle 38.

The pivotable part 42 comprises the pivotable part of the hinge 44 in the form of a sleeve which partially engages around the first axle 38. This sleeve is firmly connected to the pivotable part 42.

The control surface 40*a* has an end stop 40*d* at its upper end, which defines the maximum opening angle of the rotor compartment cover 16. However, the rotor compartment cover 16 is controlled by the spring force of the torsion spring 46, which is generated when the torsion spring 46 is biased, or by the decrease of this spring force of the torsion spring 46 at a defined point over the opening angle of the rotor compartment cover 16. This stops the rotor compartment cover 16 before the end stop 40*d* without rattling a sample in a sample container of the centrifuge 10, see above. The point designated as the end stop 40*d* is a second end stop which is reached by manually moving the rotor compartment cover 16 further down.

The holding and opening mechanism is designed symmetrically with respect to its central plane, perpendicular to the first axle 38 and second axle 58. Accordingly, the pivoting arms 48, the fixed parts 40, the pivotable parts 42 and the hinges 44 are of identical design.

The torsion spring 46 consists of several packages of fiberglass rods. The angular position of the pivoting arm 48 with respect to the torsion spring 46 in the pivotable part 42 can be adjusted. This angular position is used to set the bias of the torsion spring 46.

As a function of the characteristic curve of the torsion spring 46, the weight of the rotor compartment cover 16, the weight of the pivoting arm 48 and the geometry, in particular the arrangement of the center of gravity of the rotor compartment cover 16, the control surface 40*a* of the guide element 40*b* of the fixed part 40 is designed with a view to obtaining the desired pivoting behavior of the rotor compartment cover 16 during its opening and closing movements.

The pivoting arms 48 are made of an aluminum alloy. The surface of the roller 50 is made of metal and the control surface 40*a* is coated to ensure good rolling behavior.

The pivotable part 42 is designed as a mounting support to which the rotor compartment cover 16 can be simply screwed.

The invention is characterized by the simple design which allows the holding and opening force to be applied to the rotor compartment cover 16 in a uniformly distributed manner. In a simple way, the parts of the holding and opening mechanism 12 are largely covered, only the pivoting arm 48 for example protrudes from the rotor compartment cover 16 and the guide element 40*b* with the adjacent roller 50 is located outside the rotor compartment 36. This prevents contamination of the samples at the rotor compartment 36 of centrifuge 10.

What has been described and depicted herein are preferred, non-limiting embodiments of Applicant's subject matter, along with one or more application contexts. Since the structures of the assemblies, subassemblies, and/or mechanisms disclosed herein may be embodied in other specific forms without departing from the spirit or general characteristics thereof, some of which forms have been indicated, the embodiments described and depicted herein/with are to be considered in all respects illustrative and not restrictive. Accordingly, the scope of the subject invention is as defined in the language of the appended claims, and includes not insubstantial equivalents thereto.

LIST OF REFERENCE SIGNS

10 centrifuge
12 holding and opening mechanism

14 housing
16 rotor compartment cover
18 feet of the centrifuge 10
20 base
22 front side
24 control panel
26 back side
28 left sidewall
30 right sidewall
32 top wall
34 circular recess
36 rotor compartment
38 first axle
40 fixed part of the holding and opening mechanism, connected to housing 14
40*a* control surface
40*b* guide element
40*c* bearing portion
40*d* end stop
42 pivotable part of the holding and opening mechanism, connected to rotor compartment cover 16
44 hinge
46 torsion spring
48 pivoting arm
50 roller
58 second axle

What is claimed is:

1. Centrifuge having a holding and opening mechanism for a pivoting element comprised of a pivotable rotor compartment cover which is mounted so as to be pivotable relative to a supporting element comprised of a housing about a first axle via a joint, the holding and closing mechanism comprising:

a. a pivoting arm which is effective between the pivoting element and the supporting element and which is mounted so as to be pivotable about a second axle, a free end of the pivoting arm acting on a control surface of a guide element, a torsion spring provided which acts on the pivoting arm in a direction around the second axle; and, b. a fixed part and a part that is pivotable relative thereto, the fixed part including the guide element and the pivotable part supporting the torsion spring and the pivoting arm, the pivotable part adapted to be pivotable relative to the fixed part about the first axle, the pivotable part connected to the pivoting element and the fixed part connected to the supporting element, a holding and opening force being established by the control surface in cooperation with the torsion spring and the pivoting arm via a pivot angle of the pivoting element, multiple pivoting arms, guide elements, joints and fixed and pivotable parts being provided, the pivoting arms connected to each other by the torsion spring in the second axle.

2. The centrifuge according to claim 1, characterized in that the torsion spring extends through the pivoting arm and is located in the fixed part and/or in the pivotable part.

3. The centrifuge according to claim 1, characterized in that the torsion spring is constituted by fiberglass rods.

4. The centrifuge according to claim 1, characterized in that the torsion spring extends over 70% of a width of the pivoting element.

5. The centrifuge according to claim 1, characterized in that a bias of the torsion spring can be adjusted via an angular position of the pivoting arm with respect to the torsion spring with the part in which the latter is mounted.

6. The centrifuge according to claim 1, characterized in that the guide element is mounted in the fixed part and the pivoting arm is pivotally mounted in the pivotable part.

7. The centrifuge according to claim 1, characterized in that proceeding from the second axle, the free end of the pivoting arm extends substantially in a closing direction of the pivoting element.

8. The centrifuge according to claim 1, characterized in that the second axle with the torsion spring thereon is integrated into the pivoting element such that only the pivoting arm projects from the pivoting element and a remaining portion of the axle is covered by the torsion spring.

9. The centrifuge according to claim 1, characterized in that the joint is in the form of a hinge, which hinge comprises a fixed hinge part that is connected to the fixed part and a movable hinge part that is connected to the pivotable part, and wherein the guide element and the fixed hinge part are integrally formed and made of a common material.

10. The centrifuge according to claim 1, characterized in that the first axle and the joint are integrated into the pivoting element such that only a connection piece between the fixed hinge part and the guide element protrudes from the pivoting element.

11. The centrifuge according to claim 1, characterized in that the pivotable part mountingly supports the pivoting element.

12. The centrifuge according to claim 1, characterized in that the free end of the pivoting arm includes a roller, a surface of the roller comprising a metal coating.

13. The centrifuge according to claim 1, characterized in that the free end of the pivoting arm includes a roller, the roller supported by a bearing.

14. The centrifuge according to claim 1, characterized in that the control surface of the guide element is formed of metal.

15. The centrifuge according to claim 1, characterized in that the pivoting arm is formed of aluminum or an aluminum alloy.

16. The centrifuge according to claim 1, characterized in that a roller is supported on the free end of the pivoting arm laterally with respect to the pivoting arm.

17. The centrifuge according to claim 1, characterized in that the free end of the pivoting arm includes a roller, the roller located on a side of the pivoting arm which faces the housing of the centrifuge.

18. The centrifuge according to claim 1, characterized in that a pivoting arm, a guide element, a joint, a fixed part and a pivotable part are provided on each side of the rotor compartment cover, with the pivoting arms having a common torsion spring in the second axle.

19. The centrifuge according to claim 17 characterized in that a pivoting arm, a guide element, a joint, a fixed part and a pivotable part are provided on each side of the rotor compartment cover, with the pivoting arms having a common torsion spring in the second axle.

20. A holding and closing mechanism operative between a pivotable element and a supporting element, the pivotable element mounted so as to be pivotable relative to the supporting element, the mechanism comprising:

a. opposingly paired fixed parts, each fixed part supported by the supporting element and characterized by a guide element having a control surface, and a bearing portion;

b. opposingly paired pivotable parts, each pivotable part supported by the pivotable element, each pivotable part pivotingly united to said bearing portion of each of said fixed parts so as to delimit a hinge characterized by a first axle;

c. a torsion element operatively supported by said opposingly paired pivotable parts and extending therebetween so as to delimit a second axle; and, d. opposingly paired pivoting arms, each pivoting arm arranged for co-rotation with said torsion element at each of said pivotable parts, a free end of each of said pivotable parts adapted for engagement with said control surface of said guide element of each of said fixed parts during opening and closing movements of the pivotable element relative to the supporting element.

* * * * *